US006205737B1

(12) United States Patent
Häussler

(10) Patent No.: US 6,205,737 B1
(45) Date of Patent: Mar. 27, 2001

(54) REINFORCING CAGE

(75) Inventor: Wilhelm Häussler, Füssen (DE)

(73) Assignee: Haussler Planung GmbH, Kempten (DE)

( * ) Notice: Subject to any disclaimer, the term of this patent is extended or adjusted under 35 U.S.C. 154(b) by 0 days.

(21) Appl. No.: 09/370,764

(22) Filed: Aug. 9, 1999

(30) Foreign Application Priority Data

Aug. 17, 1998 (DE) ..... 198 37 077

(51) Int. Cl.[7] ..... E04H 12/00
(52) U.S. Cl. ..... 52/649.1
(58) Field of Search ..... 52/649.1, 576, 52/577, 687, 677

(56) References Cited

U.S. PATENT DOCUMENTS

| | | | | |
|---|---|---|---|---|
| 1,095,204 | * | 5/1914 | Golding | 52/687 X |
| 1,732,303 | * | 10/1929 | Goldsmith | 52/577 |
| 4,495,744 | * | 1/1985 | Carl | 52/576 |
| 5,797,230 | * | 8/1998 | Lassen | 52/576 X |

FOREIGN PATENT DOCUMENTS

| | | | | |
|---|---|---|---|---|
| 185548 | | 5/1956 | (AU) . | |
| 844230 | | 11/1976 | (BE) . | |
| 380339 | | 9/1959 | (CH) . | |
| 1106946 | | 5/1961 | (DE) . | |
| 1222643 | | 8/1962 | (DE) . | |
| 1910700 | | 2/1965 | (DE) . | |
| 44951 | * | 4/1966 | (DE) | 52/577 |
| 8813325 | | 1/1988 | (DE) . | |
| 443199 | | 9/1912 | (FR) . | |
| 1500155 | | 2/1978 | (GB) . | |
| 9206253 | | 4/1992 | (WO) . | |

* cited by examiner

*Primary Examiner*—Jerry Redman
(74) *Attorney, Agent, or Firm*—Notaro & Michalos P.C.

(57) ABSTRACT

To product a steel-reinforced hollow-body ceiling, reinforcing cages (10) are fitted to the ceiling area. The reinforcing cages (10) have three U-shaped stays (12) each made of round steel at an angular distance, with the U-shaped stays being welded together with two horizontal rings (18, 20) to form a stable structure which can be walked upon. A container (22), open at the bottom and having aeration holes (26) in the cover (24) can be hooked into this reinforcing cage (10). In this way the container (22) becomes buoyancy-free. Reinforcing cages (10) and containers (22) are stackable, forming truncated pyramids with a hexagonal base. The reinforcing cages (10) can be positioned with little space between them. They can be walked upon and act as spacers for the upper reinforcement of the concrete ceiling. Once concrete has been poured into place, a hollow-body reinforced-concrete ceiling or slab in honeycomb structure results.

21 Claims, 10 Drawing Sheets

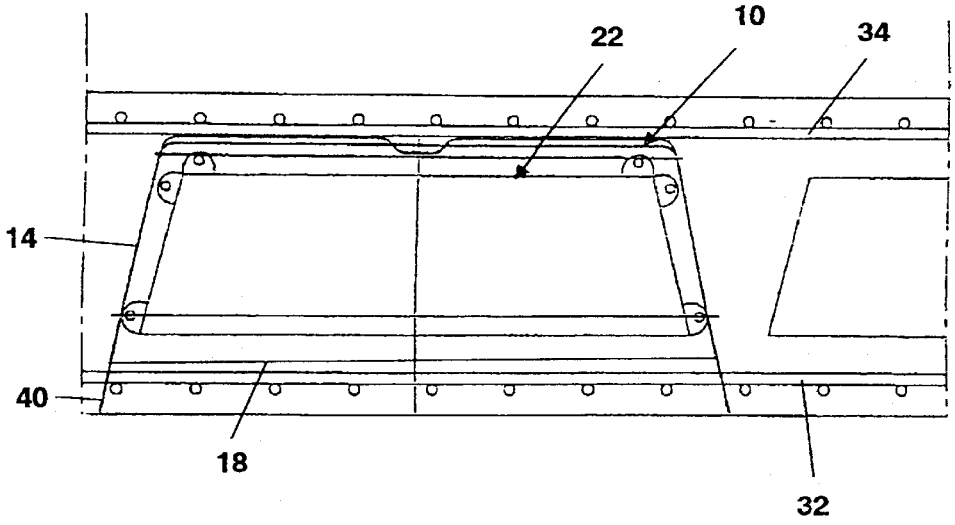
FIG. 6
FIG.7
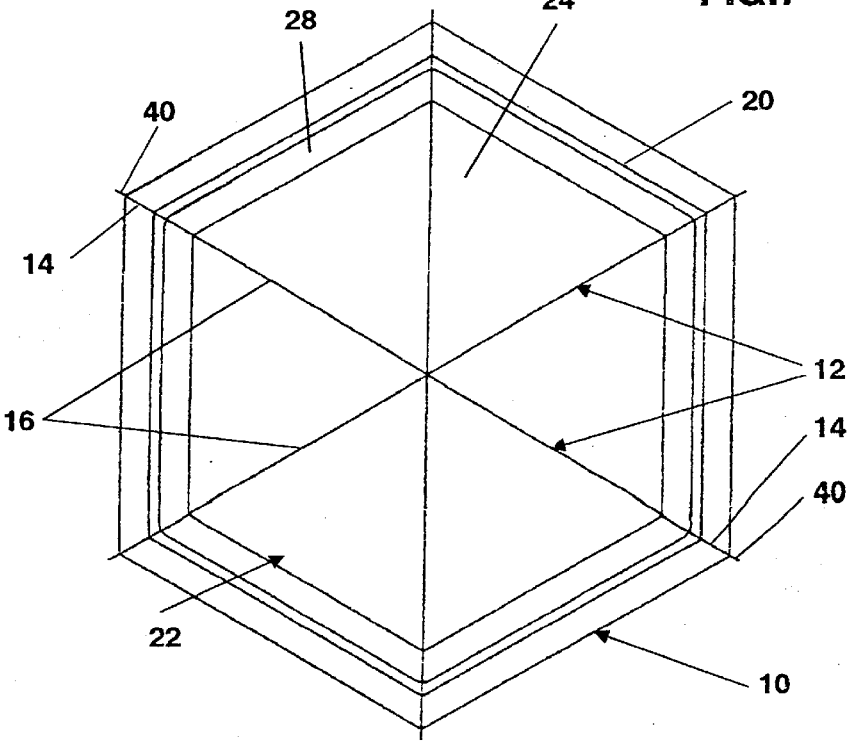

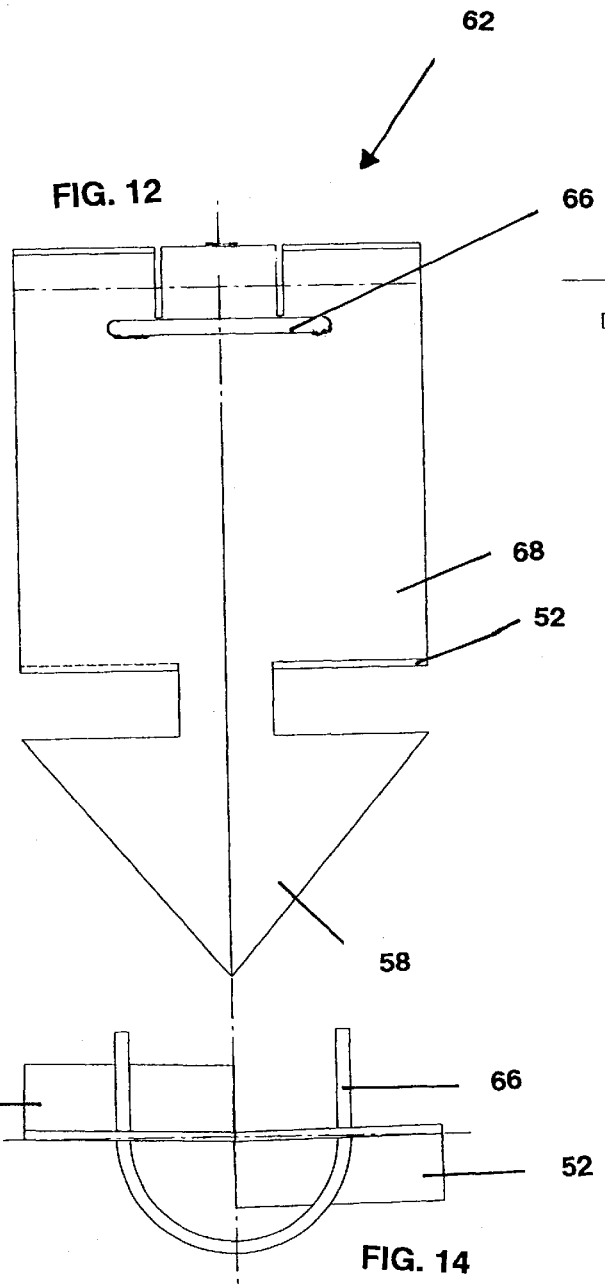
FIG. 12
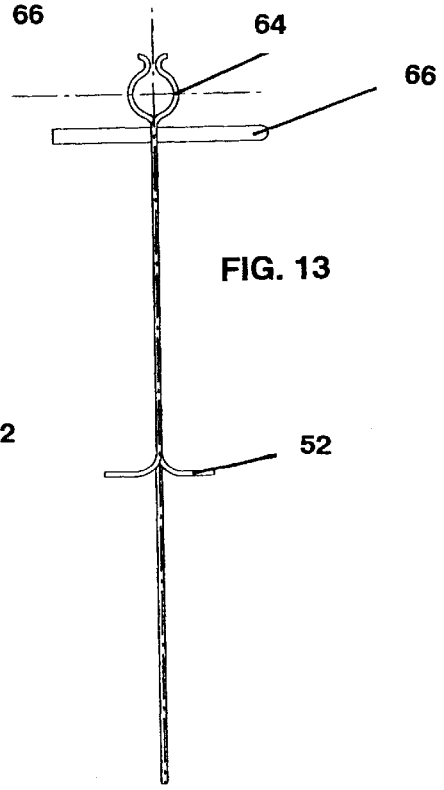
FIG. 13
FIG. 14

REINFORCING CAGE

FIELD AND BACKGROUND OF THE INVENTION

The invention relates to a reinforcing cage for holding buoyancy-free hollow bodies used in the production of reinforced concrete hollow-body slabs and ceilings. This kind of reinforcing cage is known from the registered German utility model G 88 13 325.7.

Recently, buoyancy-free hollow bodies have been used for hollow-body ceilings, with said bodies no longer requiring anchoring against buoyancy in contrast to earlier systems. Instead, they merely need to be placed on the formwork or the lower reinforcement layer. The hollow shapes comprise hollow-body formers which are open on the bottom, e.g. ribbed expanded metal where the air can escape at the top.

SUMMARY OF THE INVENTION

It is the object of the present invention to provide a reinforcing cage for such buoyancy free hollow bodies which allows arranging the hollow bodies in precisely defined positions both in the horizontal and the vertical plane and which ensures even covering with concrete of the area reinforcement and the web reinforcement.

In the reinforcing cage of the type mentioned in the introduction, in that an upper ring of round steel and a respective lower ring are attached to each other, spaced apart coaxially by means of standing braces. This object is met in that a container, open at the bottom, with a closed circumference, can be hooked into the reinforcing cage, with the cover wall of said container comprising aeration holes, with the container being at least held approximately coaxially in the reinforcing cage and with the circumferential wall of the container being at least approximately evenly spaced from the standing braces of the reinforcing cage.

According to an advantageous embodiment of the invention the upper ring is diagonally stiffened by means of horizontal braces.

Preferably the reinforcing cage is made from a number of U-shaped stays intersecting in the middle of the yoke, with said stays being arranged at equal angular distance; with the limbs of said U-shaped stays serving as standing braces.

A particularly important characteristic of the invention consists of the reinforcing cage comprising three U-shaped stays whose six limbs in horizontal section mark the corner points of a hexagon, with each of the two rings being shaped hexagonally and at the corners being welded to the limbs of the U-shaped stays.

Preferably, the reinforcing cages are in the shape of truncated pyramids, i.e. they taper slightly from bottom to top so that they are stackable. The same applies to the hollow-body forming containers which in the simplest case are of circular contours and respective conical shape. But in a preferred embodiment, the containers are also shaped as truncated hexagonal pyramids. At least the circumferential wall of the containers, but preferably in addition also the cover, comprise suspension means for attachment to the reinforcing cage and for coaxial positioning. Preferably the suspension means comprise flexible straps comprising eyelets for attaching them to the reinforcing cage using tie wire. These straps should be flexible to make it possible for the containers to be tightly stackable. In this the straps rest against the walls of the containers. Instead of straps, it is possible simply to provide pairs of holes or individual holes so as to be able to attach attachment rings or wires to the container.

Thanks to the reinforcing cages, the invention makes it possible to achieve very accurate positioning of the hollow-body forming containers. At the same time, the reinforcing cages serve as spacers for the upper reinforcement layers. They can be walked upon. Areas of web reinforcement with full concrete-encasement of the reinforcement and without change in the height of the cage, can be achieved very simply in that the reinforcing cages are used without hooked-in containers. The ceiling achieved using reinforcing cages according to the invention and hooked-in containers comprises a honeycomb structure which allows minimum wall thickness and is optimally shaped from the point of view of buckling surfaces.

The containers are matched to the reinforcing cages both horizontally and vertically, with the reinforcing cage preferably protruding from the container both at the top and at the bottom. Preferably the circumferential container wall is arranged so as to be equidistant from a circular area described by the limbs of the U-shaped stays. This distance should be approx. 2 cm which is sufficient for a concrete ceiling.

According to an embodiment, the lower hexagonal ring is attached to the ends of the six limbs. This embodiment is suitable for placing the reinforcing cage onto the lower reinforcement layer. By means of suitable spacers, the reinforcing cages can be precisely positioned and fixed to the lower reinforcement layers using tie wire. An alternative embodiment of the invention provides for the limbs of the stay protruding downwards below the lower ring. In this way, feet are formed which protrude through the lower reinforcement mats and rest on the slab's formwork. With this version, an advantageous embodiment of the invention comprises the use of positioning plates comprising three holes for inserting the feet of three limbs of three adjacent reinforcing cages. The insertion holes form the corners of an equilateral triangle. These positioning plates can be made of plastic or wood. Anchorage of the web reinforcement is provided by the hexagonal ring reinforcement.

It is understood that various thicknesses of ceilings or slabs require various sizes of reinforcing cages and thus also hooked-in containers. For example for a concrete ceiling 66 cm in thickness, a reinforcing cage is suitable whose lower ring comprises a diagonal of 70 cm and whose upper ring comprises a diagonal of approx. 60 cm with the vertical spacing between the two rings being approx. 46 cm.

A favorable machine production possibility arises, if the reinforcing cage is put together by a number of uniformly bended stays, advantageously with a U-shaped part. At one end of the U-shaped part a free leg arises. The axis of the leg is arranged outside the area of the U-shaped part. According to this fact, the reinforcing cage can be put together by a number of only one shape of steel.

According to the above described embodiments of the invention, the reinforcing cage and the hollow body are connected by latches and wires. Under circumstances the connection may be expensive and time consuming. This can be avoided advantageously, if the reinforcing cage shows a centrally fixed connection element for connecting the hollow body. For example a special element made of steel is designed and welded in the upper star of reinforcing bars. The hollow body then is hooked to this element. The number of connecting points is therefor drastically reduced.

The location of the hollow body is fixed advantageously, if the reinforcing cage shows spaces, e.g. distance flats for fixing the location of the body. A metal plate, fixed at the central connection element can also be used as a distance piece.

The assembly time can further be reduced advantageously if the connection element shows a projection, which can be brought into a locked position with the central opening of the container.

The connection element exists for example from the bottom to the top of one triangularly formed blade, one distance flat and one piece of steel. Distance flat and blade are arranged in distance, so that the thickness of the cover finds place in between.

For the assembly of the container in the reinforcing cage, the cage is turned upside down. Now the container is pressed with its top centrically into the blade with its opening. The plastic cover of the container is cut and abuts at the distance plate. The hollow body becomes fixed durably in his vertical and concentric location by a made turn of the hollow body.

According to an particularly advantageous embodiment, the connection element is built detachable. Through this, the assembly time can further be reduced.

For the assembly of the container in the reinforcing cage, the cage is turned upside down. The above end of the detachable connection element has a clamp shaped form. The connection element is fixed with this end to the reinforcing cage by putting it to a yoke. A stopper prevents the connection element from falling to the side. The projection of the connection element, which prevents a sliding through of the container, consists e.g. of two contrarily bended brackets of as tamped blank from one piece of sheet steel. For this reason the connection element can be produced cheap and in masses.

The container now is fixed flexibly. Three customary ring-like spaces made of plastic are attached to three vertical braces, between which the hollow body is fixed horizontal, to fix the container rigidly.

The connection could also consist of a hole, a screw with a nut and a locknut, if necessary with a plain washer or a clip lock.

BRIEF DESCRIPTION OF THE DRAWINGS

Below, the invention is described in more detail by means of the drawing showing embodiments of the invention, as follows:

FIG. 6 shows a lateral view of the reinforcing cage according to FIG. 5;

FIG. 7 shows a top view of the reinforcing cage according to FIGS. 5 and 6;

FIG. 12 shows an alternative embodiment of the connection element in side view;

FIG. 13 shows a top view of the embodiment according to FIG. 12 and

FIG. 14 shows a further side view of the embodiment according to FIG. 12.

DESCRIPTION OF THE PREFERRED EMBODIMENT

Figure 1:
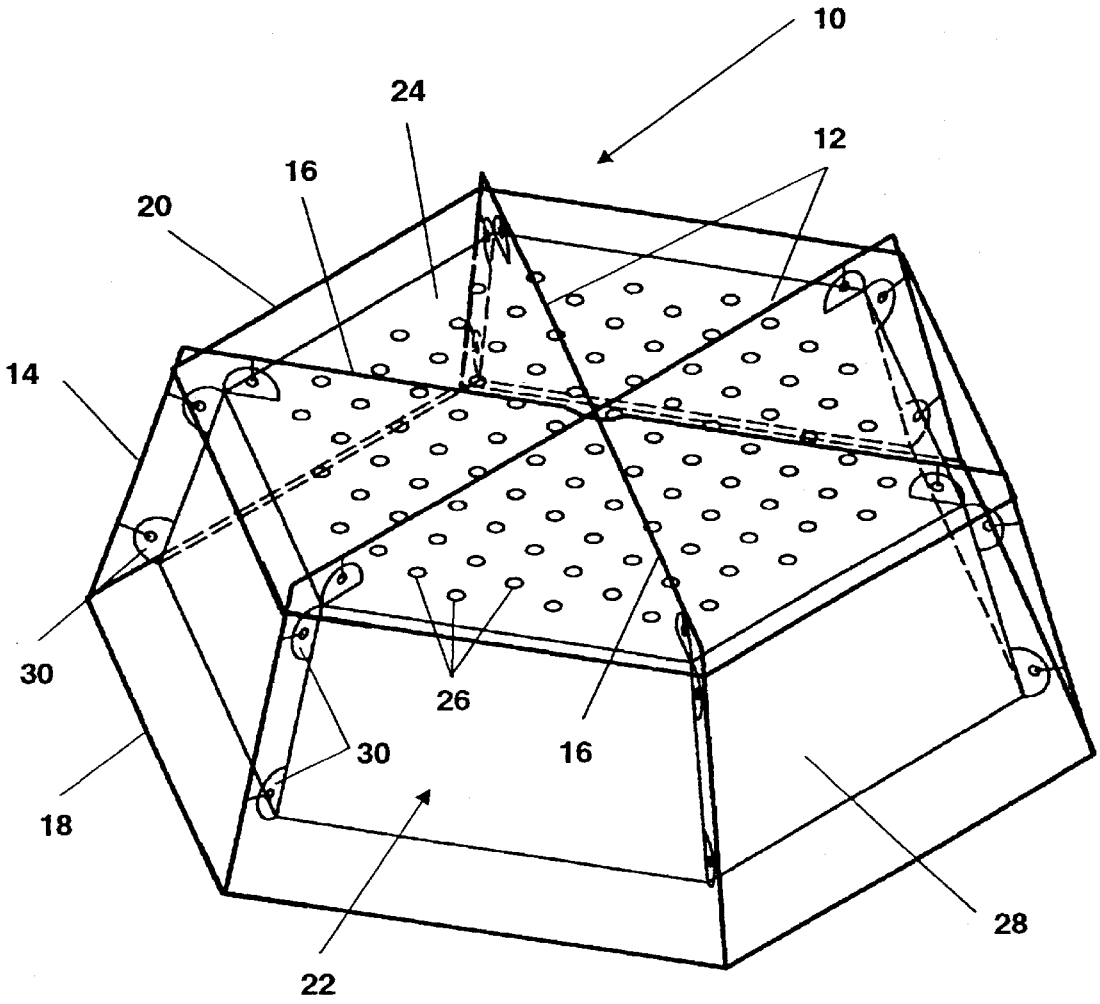
FIG. 1 is a three-dimensional view of a new reinforcing cage with hooked-in container.

A reinforcing cage or cage arrangement 10, shown in FIG. 1 comprises three U-shaped stays 12 arranged in respect of each other at an angular distance of 60° C. whose yokes intersect in the axis of the reinforcing cage 10 where they are welded together. The six limbs 14 of the three U-shaped stays 12 together define an area in the shape of a truncated hexagonal pyramid. The U-shaped stays comprise curved round steel. In the embodiment according to FIGS. 1 to 3 they terminate at the bottom in a lower hexagonal ring 18 where they are also welded to the corners of this hexagon. Just below the plane of the yokes 16 of the U-shaped stays 12, a further hexagonal ring 20 also made of round steel is welded to the limbs 14. The reinforcing cage 10 made in this way is stable and can be walked upon. The circumference of the upper ring 20 is somewhat smaller than that of the lower ring 18. Accordingly, the limbs 14 of the stays 12 are inclined, thus forming the sides of a trapezium. In the case of a reinforcing cage 10 in horizontal position, the limbs 14 form an angle to perpendicular of approx. 10°.

A container 22 which is open at the bottom and whose cover 24 comprises a number of vent apertures 26 is hooked into the reinforcing cage 10. The circumferential wall 28 of the container 22 comprises six plane surfaces which are equidistant to the imaginary areas described by the limbs 14 of the U-shaped stays. Thus the container 22 represents a truncated pyramid of hexagonal cross section. The circumference of the container is somewhat smaller than the circumference of the hexagon described by the limbs 14, with the spacing between container walls 28 and limbs 14 being suitable for adequate covering with concrete of the limbs 14; in the embodiment shown, this spacing is between 2 and 3 cm. On the cover 24 and on the outside edges of the circumferential wall 28, the container 10 comprises suspension straps 30 by means of which the container 22 is attached to the yokes 16 and the limbs 14 of the reinforcing cage 10, in particular fixed by means of tie wire.

The reinforcing cages 10 are sufficiently conical in shape to be able to be stacked. The same applies to the containers 22 where the suspension straps 30 need to be flexible to make it possible for the containers to be tightly stacked.

The reinforcing cage 10 with the hooked-in hollow-body forming container 22 is placed onto the lower reinforcement layer 32 in a precisely defined position where it is attached by means of tie wire. After completely covering the lower reinforcement layer 32 with reinforcing cages 10, said reinforcing cages 10 form a plane which can be walked upon and upon which the upper reinforcement 34 is arranged. Thus the reinforcing cages 10 carry the upper reinforcement 34 thus serving as spacers between the lower reinforcement 32 and the upper reinforcement 34. The yokes of the U-shaped stays of the reinforcing cages 10 are also tied to the upper reinforcement 34.

Figure 11:
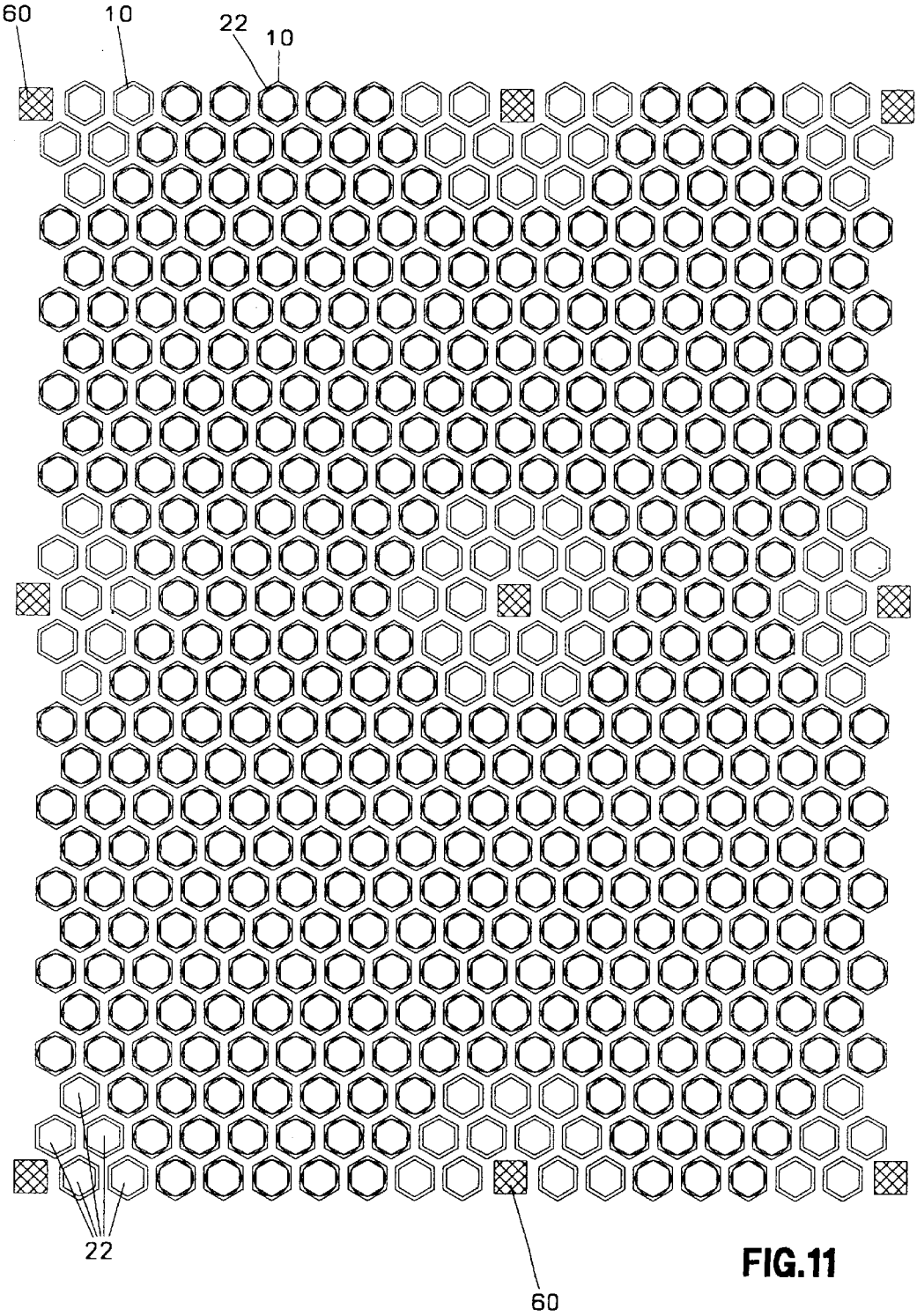
FIG. 11 shows a top view to a honeycomb design of a hollow body ceiling.

In areas of high transverse strain, in particular in support areas, the same reinforcing cages 10 are however used without the hooked-in containers 22, shown in FIG. 11.

Figure 4:
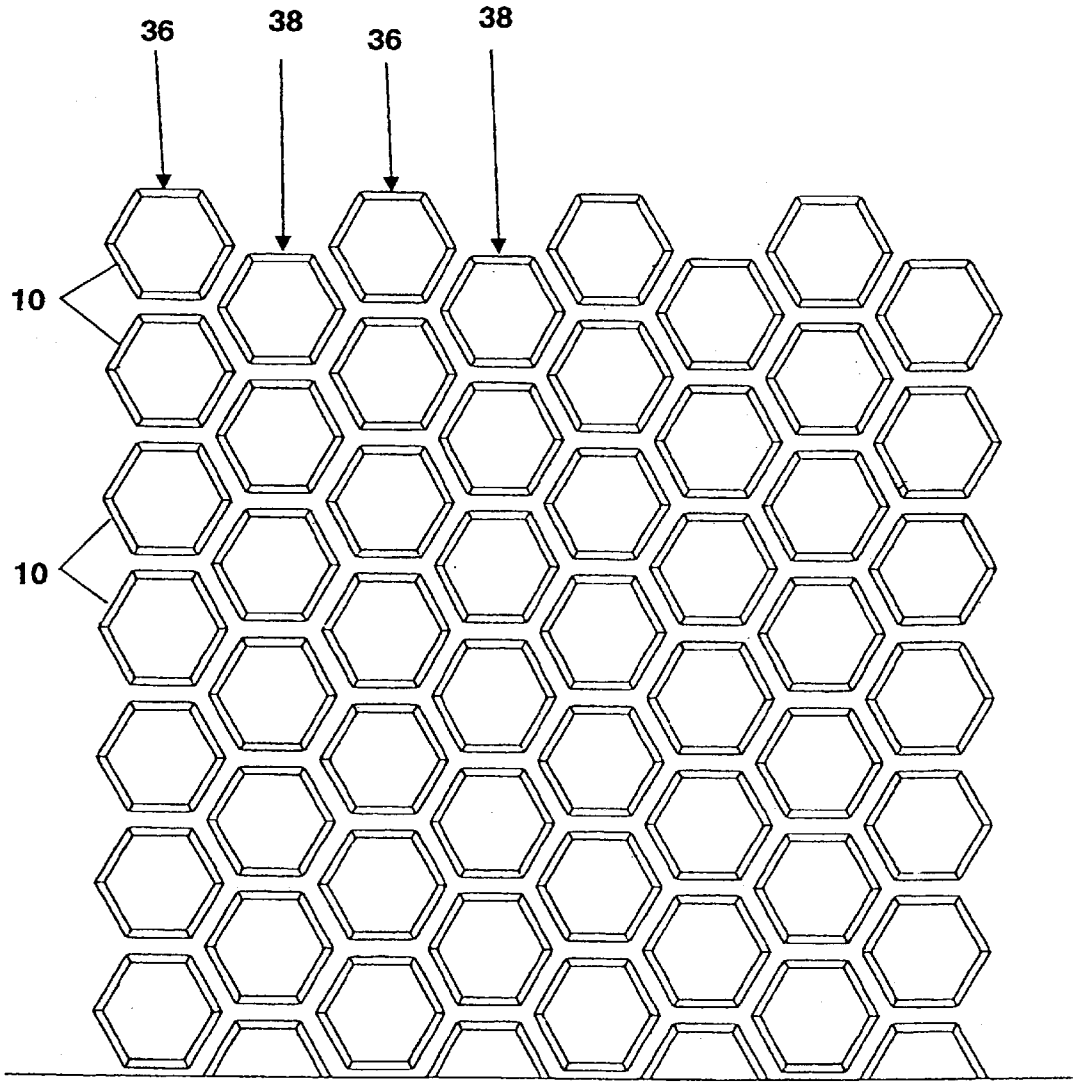
FIG. 4 shows the honeycomb design of a reinforced concrete hollow-body ceiling, achieved with the reinforcing cages according to FIGS. 1 to 3.

FIG. 4 is a top view of an arrangement of the reinforcing cages 10 for a reinforced concrete ceiling. As shown in this Fig., the reinforcing cages 10 are arranged in parallel rows 36, 38 with the rows being offset by half a spacing. In each instance, three adjacent hexagonal reinforcing cages form an imaginary triangle at three adjacent corners. The wall areas of the hooked-in containers 22 (not shown in FIG. 4) delimit the wall stays which will form after pouring the concrete; thus giving the concrete ceiling a honeycomb structure.

Figure 2:
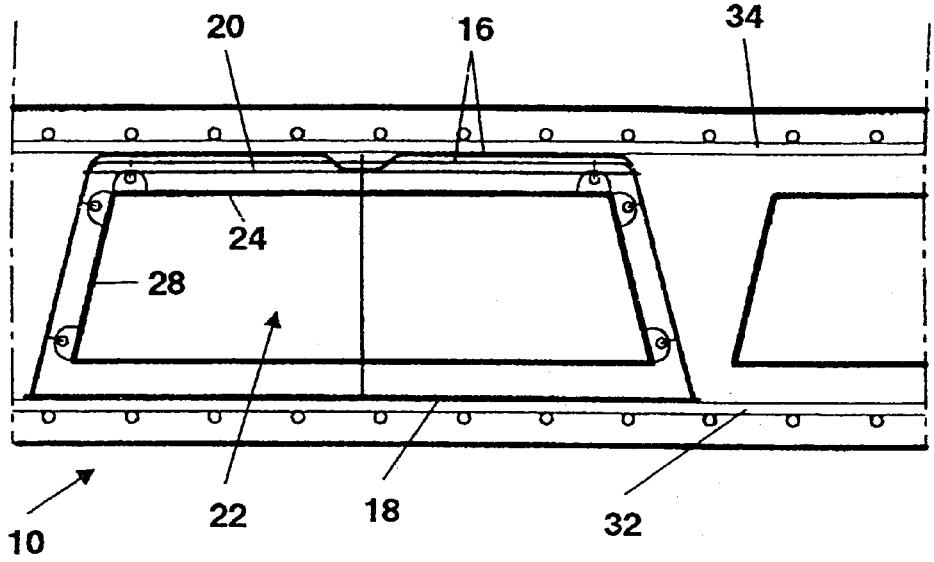
FIG. 2 is a lateral view of an installed reinforcing cage between a lower and an upper reinforcement layer of a concrete ceiling.
Figure 3:
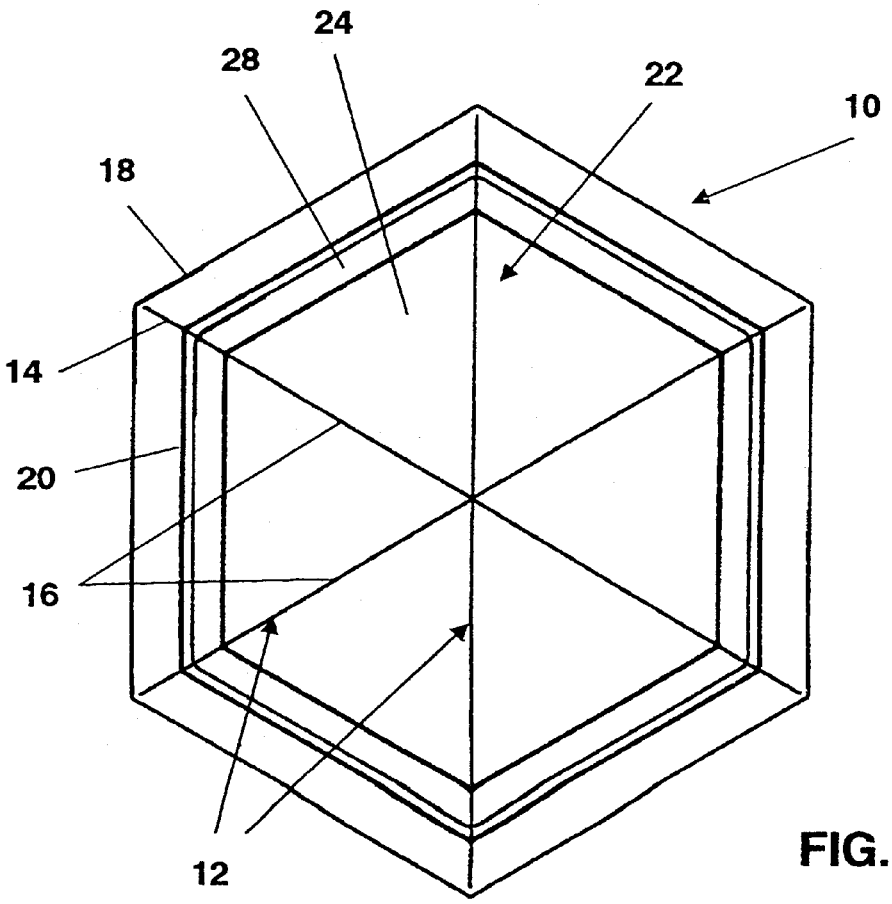
FIG. 3 is a top view of the reinforcing cage according to FIGS. 1 and 2.

As is shown in FIG. 2, the container 22 is lower than the reinforcing cage 10, with the cover 24 of the container 22 being arranged at a distance below the yokes 16 of the reinforcing cage 10. In this way, the upper reinforcement layer 34 will have a sufficient covering of concrete. The lower rim of the container 22 is at a distance from the lower ring 18 which rests on the lower reinforcement layer 32 so that here too, an adequate cover of concrete is ensured.

Figure 5:
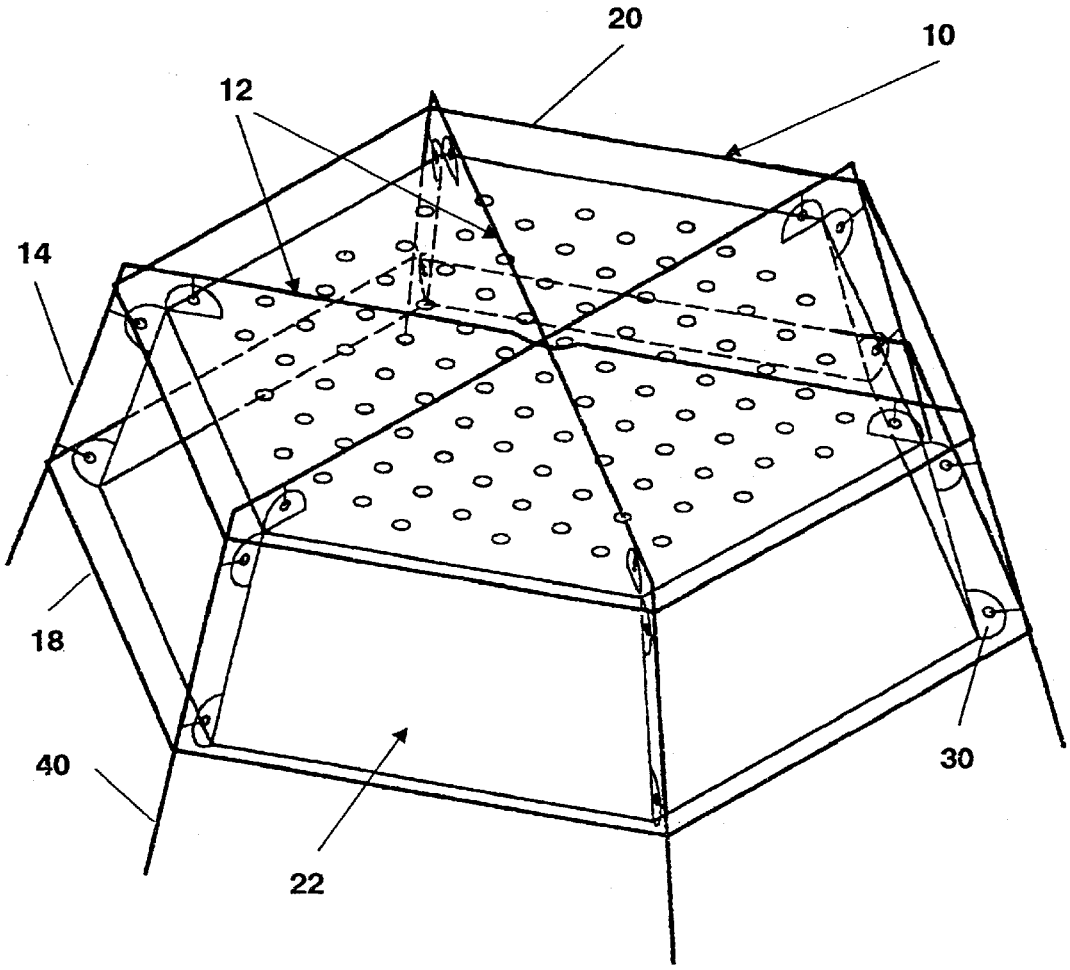
FIG. 5 shows a three-dimensional view of a modified embodiment of a reinforcing cage.

The embodiment according to FIGS. 5 to 7 differs from the embodiment described above only in that the limbs 14 of the U-stays 12 of the reinforcing cage 10 are longer and protrude beyond the lower hexagonal ring 18. These limb extensions form the feet 40 of the reinforcing cage 10; with said feet intended to be placed on the formwork of the ceiling. In the case of exposed concrete ceilings, plastic caps can be used for the feet. However, thanks to the protruding feet 40, the embodiment according to FIG. 5 permits an elegant positioning system which instead of individual caps uses positioning plates, each plate comprising three holes; said positioning plates forming the corners of an equilateral triangle. The three adjacent feet 40 of three adjacent reinforcing cages 10 are then inserted into these holes and can therefore be positioned with extreme accuracy and thus also in closer proximity to each other, so as to create thin honeycomb structures of the hollow-body ceiling. In the embodiment according to FIGS. 5 to 7, the length of the feet 40 is preferably such that the lower ring 18 of the reinforcing cage 10 rests on the lower reinforcement layer 32 or is only slightly spaced apart in the vertical plane from said reinforcement layer 32, so as to allow tying the reinforcing cage 10 to the lower reinforcement 32.

Figure 8:
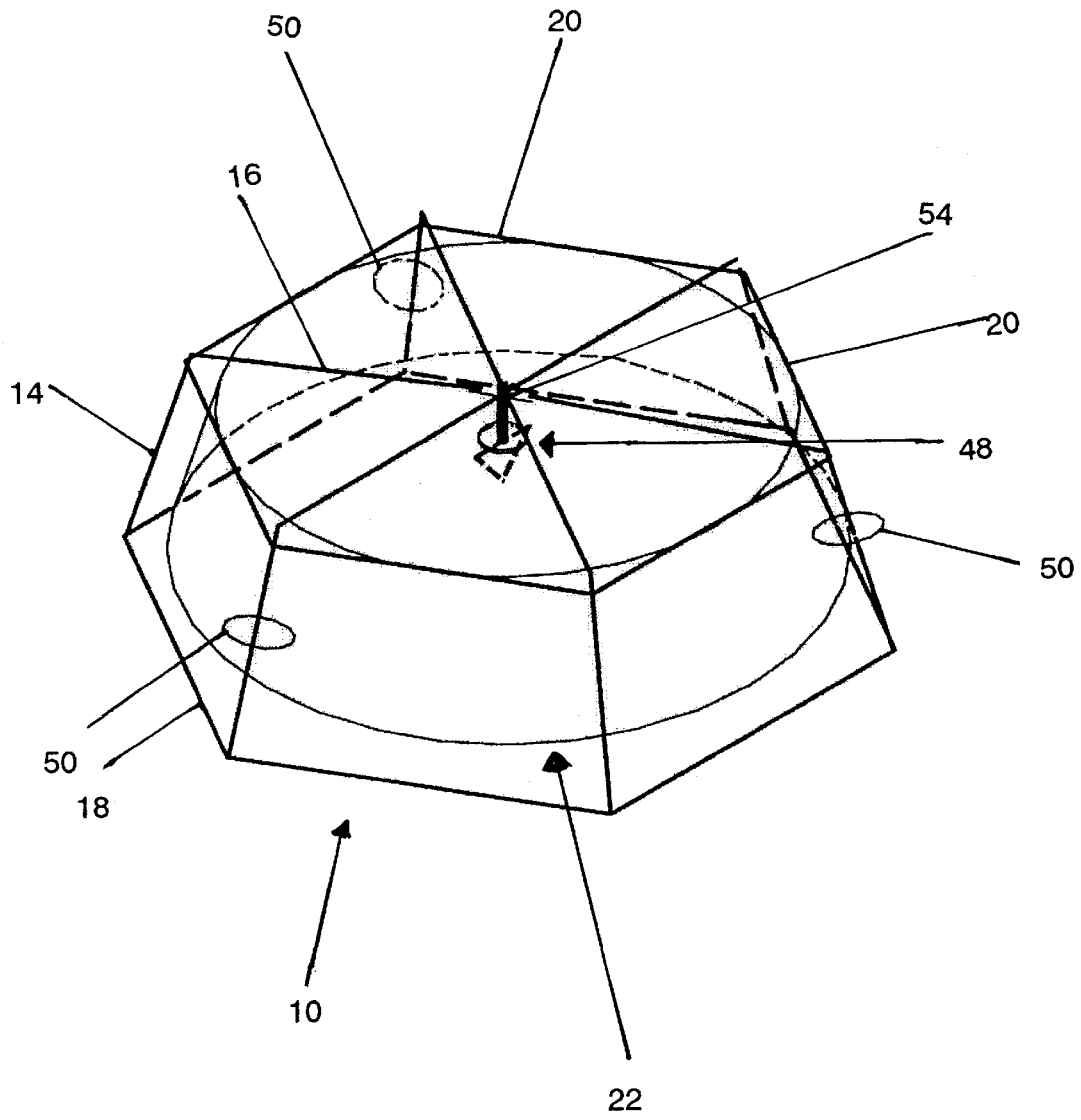
FIG. 8 shows a three-dimensional view of an alternative reinforcing cage with container hooked-in with the connection element.

FIG. 8 shows a reinforcing cage 10, with a centrally fixed connection element 48. This connection element 48 is welded axial to the upper star of concrete steel 54. A container 22 can be hooked to the connection element 48. Customary distance flats 50 are attached to three of the six vertical braces 14 in middle height to fix the container 22 rigidly.

Figure 9:
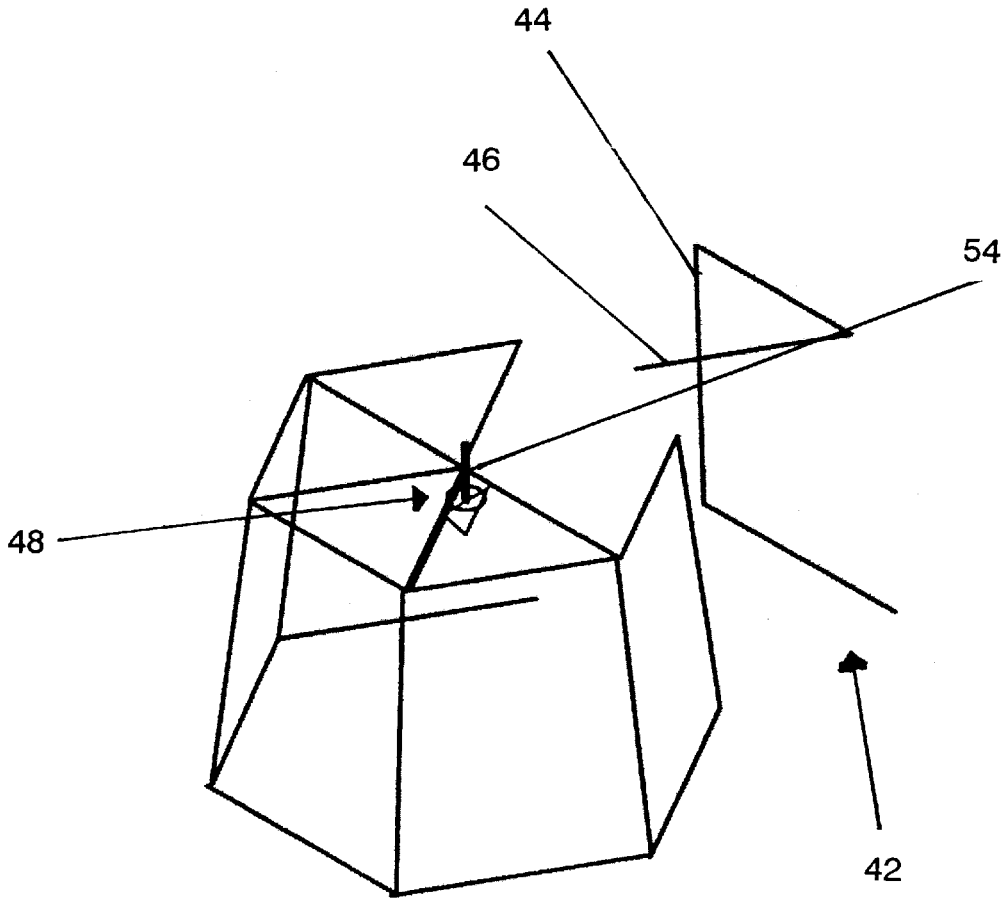
FIG. 9 shows a three dimensional view of a reinforcing cage and its components.

FIG. 9 shows a machine production possibility of the reinforcing cage 10. It is shown, that the reinforcing cage 10 consists of six uniform bended stays 42. The bended stay 42 consists of a U-shaped part 44 with an attached limb 46, whose axis is arranged outside the area of the U-shaped part. The bended stays of steel 42 are arranged in that way, that the attached limbs 46 meet in the center of the reinforcing cage 10, where they are welded to a star of concrete steel 54. In addition, all corners of the U-shaped part 44 are connected to the corresponding, adjacent U-shaped part 44. So, the reinforcing cage 10 can be produced easily by a number of six equal parts. The structure can also be divided in different sub-structures.

Figure 10:
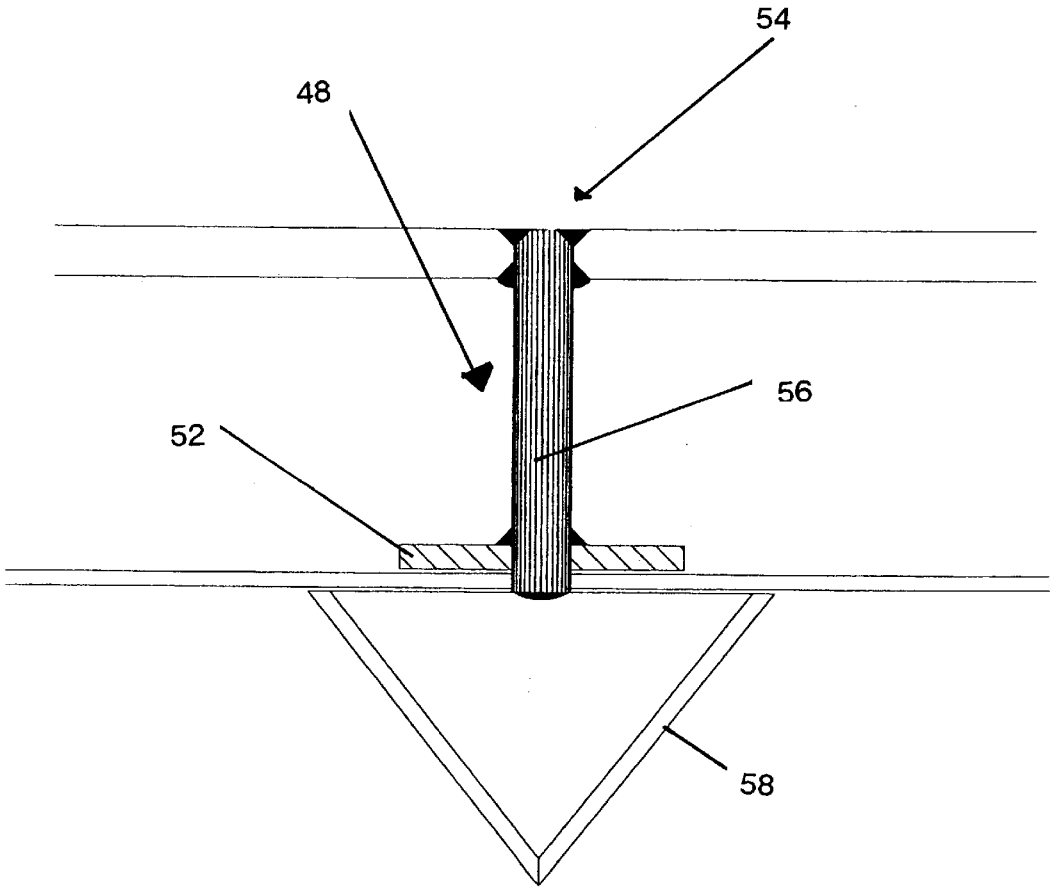
FIG. 10 shows a detail view of the connection element.

FIG. 10 shows the connecting element 48 in detail. A piece of concrete steel 56 is welded to the center of the star of concrete steel 54. A triangularly formed blade 58 is attached to the lower end of the concrete steel 56. The blade 58 can be brought to a locked position with the center opening of the hookable container 22. A distance flat 52 is attached. above the blade 58. Distance flat 52 and blade 58 get a distance, so that the cover 24 finds place in between.

FIG. 11 shows the honeycomb design of a reinforced concrete hollow-body ceiling, achieved with the reinforcing cages 10 and containers 22. It can clearly be seen, that in areas of high transverse strain, in particular in support areas, reinforcing cages without the hooked-in containers 22 are used.

FIG. 12 shows an particularly advantageous, alternative embodiment of the connection element 62. The projection 52 consists of two contrarily bended brackets of a stamped blank piece of sheet steel. The above end 64 of the detachable connection element 62 has a clamp shaped form. The connection element 62 is fixed with this end to the reinforcing cage 10 by putting it to a yoke 16. A stopper 66, which abuts to a yoke 16 when required, prevents the connection element 62 from falling to the side.

FIGS. 13 and 14 show flap view of this advantageous embodiment of the connection element 62. In FIG. 13 the clamp shaped end 64 of the connection element 62 can clearly be seen. In FIG. 14 the location of the holding device 66 and of the projection 52 is shown very clearly.

What is claimed is:

1. A reinforcing cage for holding hollow bodies used in production of reinforced concrete hollow-body slabs and ceilings, comprising:

an upper ring (20) of round steel; a lower ring (18) attached to the upper ring and spaced apart coaxially from the upper ring by vertical braces and forming a cage arrangement;

a container (22) having an open bottom and a closed circumferential wall (28) in the cage arrangement (10); the container having a cover wall (24) including aeration holes (26), the container (22) being at least held approximately coaxially in the cage arrangement (10) and with the circumferential wall (28) of the container (22) being at least approximately evenly spaced horizontally, from the vertical braces of the cage arrangement.

2. A reinforcing cage according to claim 1, wherein the upper ring (20) is diagonally stiffened by means of horizontal braces.

3. A reinforcing cage according to claim 1, wherein the yokes (16) of the U-shaped stays (12) are arranged above a plane defined by the upper ring (20).

4. A reinforcing cage according to claim 1, wherein the container (22) evenly tapers in from an open lower end towards the cover wall (24) and is stackable.

5. A reinforcing cage according to claim 1, including a centrally attached connection element to fix the container, and defining a detachable connection element (62).

6. A reinforcing cage according to claim 1, including distance flats 50 to fix a location of the container 22.

7. A reinforcing cage according to claim 1, including a connecting element (48) with a projection (52), which can be brought into a locked position with a central opening of the container (22).

8. A reinforcing cage according to claim 1, including a plurality of U-shaped stays (12) each having a yoke, said yokes intersecting and spaced apart by equal angular distances, each stay having a pair of limbs (14), said limbs defining said vertical braces which connect said upper and lower rings to each other.

9. A reinforcing cage according to claim 8, wherein the yokes (16) of the stays (12) are welded together where they intersect.

10. A reinforcing cage according to claim 8, wherein the lower ring (18) is welded to the free ends of the limbs (14) of the U-shaped stays (12).

11. A reinforcing cage according to claim 8, wherein the lower ring (18) is welded to the limbs (14) at a distance above a floor plane defined by free ends of the limbs (14) of the U-shaped stays (12).

12. A reinforcing cage according to claim 8, wherein the circumference of the upper ring (20) is less than that of the lower ring (18) and the limbs (14) are aligned at an angle ranging from 30° to 20° in respect to the axis of the reinforcing cage (10), so that several reinforcing cages are stackable.

13. A reinforcing cage according to claim 8, wherein the circumferential container wall (28) is arranged so as to be equidistant from a circular area described by the limbs (14) of the U-shaped stays (12).

14. A reinforcing cage according to claim 8, wherein the cover wall (24) of the container (22) is attachable at a distance below the yoke (16) of the U-shaped stays (12).

15. A reinforcing cage according to claim 8, wherein a the lower margin of the circumferential wall (28) of the container (22) is arranged above a floor plane defined by free ends of the limbs (14) of the U-shaped stays (12).

16. A reinforcing cage according to claim 8, including three of said U-shaped stays (12) with six of said limbs (14), said limbs defining corners of a hexagon, said upper and lower rings both being hexagonal in shape with the limbs being welded at corners of the upper and lower rings.

17. A reinforcing cage according to claim 1, including suspension means (30) for coaxial arrangement of the container (22) in the cage arrangement (10), extending from at least one of the cover wall (24) and the circumferential wall (28).

18. A reinforcing cage according to claim 1, wherein the cage arrangement comprises a plurality of uniform bended stays (42) each including a U-shaped part (24), each uniform bended stay also including an attached limb (46) extending out of a plane containing the U-shaped pat of each uniform bended stay.

19. A reinforcing cage according to claim 1, including a plurality of cage arrangements (10), a lower reinforcing layer (32) for receiving a reinforcing cement slab, the reinforcing cage arrangement being arranged in parallel rows (36, 38).

20. A reinforcing cage according to claim 19, wherein each of the cage arrangements is hexagonal, the vertical braces of three adjacent cage arrangements in the row of cage arrangements forming an equilateral triangle, a side of each equilateral triangle being from one to four times a distance of each vertical brace and the container in each respective reinforcing cage.

21. A reinforcing cage according to claim 1, including a plurality of cage arrangements and a positioning plate having a hole therein, a vertical brace of each of three adjacent cage arrangements extending into the hole of the positioning plate.

* * * * *